US007691013B2

(12) United States Patent
Emerson

(10) Patent No.: US 7,691,013 B2
(45) Date of Patent: Apr. 6, 2010

(54) METHOD AND DEVICE FOR TENNIS TRAINING

(75) Inventor: Steve Emerson, Mechanicsville, VA (US)

(73) Assignee: Steven A Emerson, Mechanicsville, VA (US)

( * ) Notice: Subject to any disclaimer, the term of this patent is extended or adjusted under 35 U.S.C. 154(b) by 611 days.

(21) Appl. No.: 11/605,414

(22) Filed: Nov. 29, 2006

(65) Prior Publication Data

US 2007/0123373 A1 May 31, 2007

Related U.S. Application Data

(60) Provisional application No. 60/740,109, filed on Nov. 29, 2005, provisional application No. 60/797,356, filed on Jul. 21, 2006.

(51) Int. Cl.
*A63B 69/38* (2006.01)

(52) U.S. Cl. ..... 473/459; 473/423; 473/424; 473/429; 473/430

(58) Field of Classification Search ..... 473/459, 473/423–425, 429, 430
See application file for complete search history.

(56) References Cited

U.S. PATENT DOCUMENTS

| | | | | | |
|---|---|---|---|---|---|
| 2,942,883 | A * | 6/1960 | Moore | 473/424 |
| 3,531,115 | A * | 9/1970 | Alexander | 473/424 |
| 3,593,998 | A * | 7/1971 | Pattyn | 473/430 |
| 3,731,925 | A * | 5/1973 | Caldwell | 473/424 |
| 3,948,517 | A * | 4/1976 | Feiler | 473/429 |
| 3,994,494 | A * | 11/1976 | Kelley | 473/430 |
| 4,023,298 | A | 5/1977 | Story | |
| 4,032,145 | A * | 6/1977 | Tami | 273/317.8 |
| 4,079,934 | A * | 3/1978 | Nixon | 473/430 |
| 4,243,221 | A | 1/1981 | Ferreira-Godinho | |
| 4,577,864 | A * | 3/1986 | Aldrich | 473/424 |
| 5,011,143 | A | 4/1991 | Jones | |
| 5,433,435 | A * | 7/1995 | Bourie | 473/424 |
| 5,458,327 | A * | 10/1995 | Crespin | 473/424 |
| 5,467,978 | A * | 11/1995 | Paluch | 473/429 |
| 5,492,321 | A * | 2/1996 | Cipriano | 473/424 |
| 6,099,419 | A * | 8/2000 | Incaudo et al. | 473/429 |
| 6,142,889 | A * | 11/2000 | Schaubach | 473/426 |
| 6,786,841 | B1 * | 9/2004 | Dixon | 473/451 |
| 6,837,808 | B1 * | 1/2005 | Hatch | 473/424 |
| 7,115,051 | B2 * | 10/2006 | Hansberry | 473/423 |
| 2003/0224880 | A1 * | 12/2003 | Hansberry | 473/430 |
| 2006/0014597 | A1 * | 1/2006 | Cantu et al. | 473/422 |
| 2006/0035730 | A1 * | 2/2006 | Nguyen | 473/417 |
| 2006/0293124 | A1 * | 12/2006 | Mooney | 473/421 |
| 2007/0202968 | A1 * | 8/2007 | Zappel et al. | 473/424 |
| 2007/0238556 | A1 * | 10/2007 | Gipple | 473/459 |
| 2009/0075763 | A1 * | 3/2009 | Wu et al. | 473/424 |

* cited by examiner

*Primary Examiner*—Raleigh W. Chiu

(57) ABSTRACT

A tennis training device comprises a ball, a rope, and a hollow pole, the ball being coupled with a portion of a first end of the rope, a part of the rope being in a cavity of the pole, the rope being knotted at or near the second end of the rope. The training device may be coupled with a support. A method of training various tennis shots comprises the steps of obtaining the training device; adjusting a length of a first portion of the rope which is outside the pole between an first end of the pole and the first end of the rope; holding the pole to set the ball at a selected height; and allowing a player to hit the ball with a tennis racquet. Multiple trainers may participate the training with the training devices and allow a player to practice a combination of different tennis shots.

33 Claims, 15 Drawing Sheets

METHOD AND DEVICE FOR TENNIS TRAINING

This application claims priority under 35 U.S.C. §119 to Provisional Patent Application No. 60/740,109, filed Nov. 29, 2005, and to Provisional Patent Application No. 60/797,356 filed Jul. 21, 2006, the entirety of which are incorporated herein by reference.

FIELD OF INVENTION

The invention generally relates to methods and apparatus for training tennis skills. These skills include, but are not limited to the tennis serve, the ground and back stroke, and the volley. More particularly, the invention relates to methods and apparatus for aiding a player in improving various kinds of tennis skills.

BACKGROUND OF THE INVENTION

A tennis player desires to repeatedly practice various kinds of skills such as ground and back stroke, a serve, and a volley to learn proper shots and stroke development. Generally, a trainer throws or hits a ball toward the player. Alternatively, a machine directs a ball toward the player. To learn a proper ball/racquet contact point, timing, and stroke development, it is effective for a player to visualize proper ball placement and hit a ball at a constant location. However, it is difficult for instructor or a machine to repeatedly locate a ball to consistently train the student. Furthermore, because a trainer or machine provides many balls toward a player and the player hits those in the court, many balls are left on the court, and a player or a trainer has to retrieve the balls. Additionally, the instructor is usually a distance away from the student (across the net) and must physically move to the student and/or make a deliberate effort to turn off the machine to address the teaching point to the student. Finally, a student/instructor lesson is limited to a specific designated tennis facility in order to support the lesson plan.

Pronin (U.S. Pat. No. 4,023,798) discloses a training device for practicing a tennis serve. The device consists of a frame which supports an overhead target and a cooperating ground surface target. A player learns a proper position for standing and tossing a ball for a serve. The overhead target is movably mounted and adjustable in height so that its lowermost surface can be readily placed at the optimum toss height for the user's serve and it will move when struck to indicate an overtoss.

Ferreira-Godinho (U.S. Pat. No. 4,243,221) discloses a tennis device for practicing a tennis serve. The device comprises a second net rising above the conventional play net and a recovery net arranged before the play net. The second net intercepts balls served toward the conventional net. The recovery net catches the balls and lets them roll out to the base line through a ball outlet. This device is purported to allow a player to easily retrieve the balls served. However, because a player hits many balls to repeatedly practice serves, he/she has to collect many balls.

Jones (U.S. Pat. No. 5,011,143) discloses a tennis training device for practicing a tennis serve. The device comprises a height adjustment pole secured to a tennis court, a target support arm, and a target. The target support arm extends horizontally from the pole and swings in a horizontal plane when a player hits the target. This device does not require a player retrieve many balls served. However, because the shape of the target is not a ball, but a pole and the target moves in a horizontal plane, player cannot experience actual feeling of serving a ball when he/she hits the target.

In these devices, it is not easy to adjust the height of the target to be hit. Moreover, these devices are designed only for practicing a serve. A tennis player cannot practice other shots such as a stroke and volley and the combination of various shots, for example, a serve and a volley, and ground strokes and a volley.

It is the objective of the present invention is to provide a simple device for training various kinds of tennis shots without need of retrieving tennis balls shot by a player.

It is another objective of the present invention to provide a simple device for training tennis skills which can easily adjust the position of the ball regardless of the height of the player and the kind of a shot to be practiced.

Another objective of the present invention is to provide a simple device for self-training various kinds of tennis shots without need of retrieving tennis balls shot by a player.

It is another objective of the present invention to provide a method of tennis training with the device for training tennis shots provided by the present invention.

It is another objective of the present invention to provide a method and a device for training children's tennis shots, particularly a serve.

It is another objective of the present invention to provide a method and a device for training children's tennis shots, particularly a serve in a location that is not tennis centric, meaning that the training can be either on a tennis court or outside the traditional location/place where tennis is instructed/taught.

SUMMARY OF THE INVENTION

The present invention provides a method for tennis training comprising the steps of obtaining a tennis training device comprising a ball, a rope, and a hollow pole, the ball being coupled with a portion of a first end of the rope, a part of the rope being in a cavity of the hollow pole, the rope being knotted at or near the second end of the rope; adjusting a length of a first portion of the rope, the first portion being outside the pole and between an end of the pole and the first end of the rope; holding the pole to set the ball at a selected height (7.5 FT); and allowing a player to hit the ball with the tennis racquet. This method enables a player to repeatedly practice various kinds of tennis shots such as a serve, a stroke, and a volley without retrieving a lot of balls.

The present invention further provides a method for training tennis shots where the trainer holds a tennis training device and allows a player to practice a combination of the same or different shots.

The present invention further provides a method for training tennis shots in which a single player can use the present invention without a trainer to allow a player to practice a combination of the same or different shots.

The present invention further provides a method for training a tennis player comprising the steps of obtaining a tennis training device comprising a ball, a rope, and a hollow pole, the ball being coupled with a portion of a first end of the rope, a part of the rope being placed in the hollow pole, the rope being knotted at or near the second end of the rope; allowing a player to adjust the length of the first portion of the rope, the first portion being outside the pole between an end of the pole and the first end of the rope; allowing the player to hold the pole to set the ball at a selected height; and allowing the player to hit the ball with a tennis racquet.

The present invention further provides a tennis training device comprising: a ball; a rope, a portion of a first end of the rope being coupled with the ball and a portion of a second end of the rope being knotted; and a hollow pole comprising a first end and a second end, a part of the rope being in a cavity of the hollow pole, the other part of the rope being outside the hollow pole. The base is adapted for being secured on a fence or placed on the floor.

The present invention further provides a combination of the above mentioned tennis training device a member for supporting the hollow pole, the member for supporting the hollow pole comprising a base; a column being attached on the base; and a tube comprising a first end being coupled with a side of the column and a second end adapted for coupling with the hollow pole.

The present invention further provides a combination of the above mentioned tennis training device a member for supporting the hollow pole, the member for supporting the hollow pole comprising a base; a first column being attached on the base; a second column being coupled with a top of the first column; and a tube comprising a first end being coupled with a side of the column and a second end being adapted for being coupled with the hollow pole.

BRIEF DESCRIPTION OF THE DRAWINGS

FIG. 16(*a*) is a plain view of one embodiment of a member for supporting the tennis training device shown in FIG. 1.

FIG. 16(*b*) is a plain view of a base section for the supporting member shown in 16(*a*).

FIG. 16(*c*) is an alternate view of the supporting member shown in 16(*a*).

DETAILED DESCRIPTION

Figure 1:
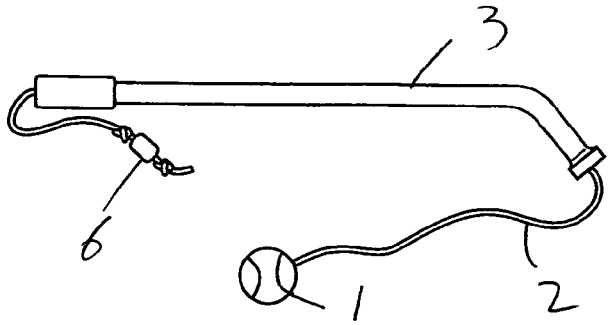
FIG. 1 is one embodiment of the tennis training device of the present invention.

FIG. 1 shows one embodiment of a tennis training device in the present invention. The tennis training device comprises a ball 1, a rope 2, and a hollow pole 3.

Figure 2:
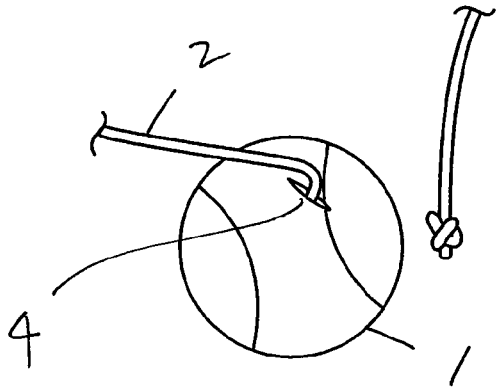
FIG. 2 is a top view of the ball of the tennis training device shown in FIG. 1.
Figure 3:
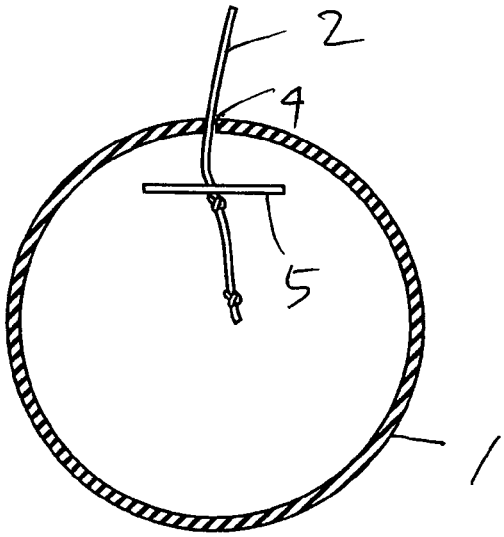
FIG. 3 is a cross-sectional view of the ball shown in FIG. 2.

A portion of a first end of the rope 2 is coupled with the ball. For example, as shown in FIG. 2, the ball 1 comprises a cut 4 on its surface. The depth of the cut is approximately 2.5 inches. Preferably, the length of the cut is approximately the same as the diameter of washer 5. FIG. 3 shows a cross-section of the ball 1 into which the washer 5 is inserted. A portion of the first end of the rope 2 is knotted with the washer. A portion nearer the first end of the rope 2 than the portion knotted with the washer may be also knotted. The washer is inserted through the cut 4 into the ball 1. Then, the rope 2 is pulled to secure the position of the washer in the ball 1 to be approximately parallel to the cut on the surface of the ball so that the washer cannot be pulled out of ball.

Figure 4:
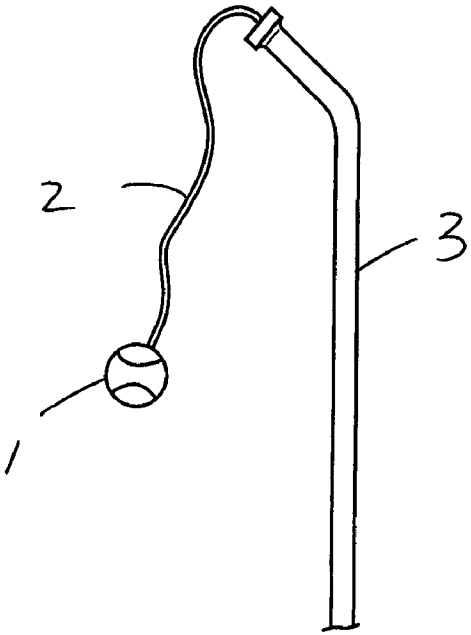
FIG. 4 is a perspective view of the tennis training device positioned vertically.

An entire part of the hollow pole 3 may be straight. Preferably, a part near a first end of hollow pole 3 is bent as shown in FIG. 1. More preferably, a bending angle of the pole 3 is set to allow the ball not to touch a straight portion of the hollow pole 3 when the straight portion is positioned vertically, as shown in FIG. 4. Preferably, the length of hollow pole 3 is 33 inches.

Figure 5:
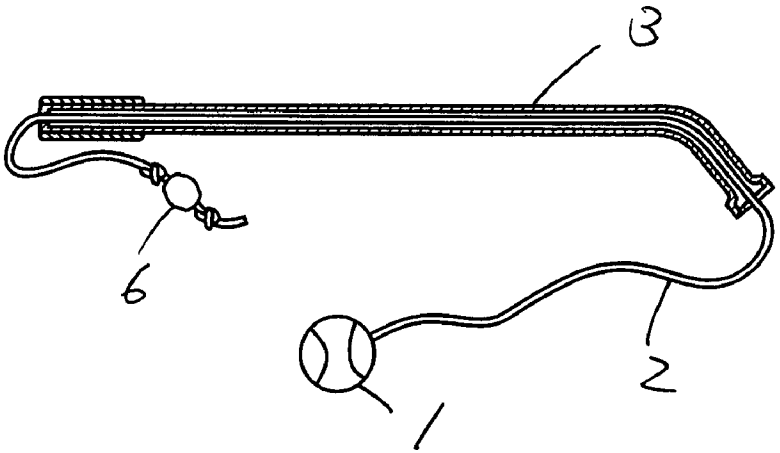
FIG. 5 is a cross-sectional view of the tennis training device.

FIG. 5 shows a cross-sectional view of the tennis training device. The rope 2 is inserted through the hollow pole 3. At least one part between the first end and the second end of the rope 2 is in the cavity of the hollow pole 3. Both the first end and second end of rope 2 are placed outside the hollow pole 3. A portion of the second end of the rope 2 is also knotted or knotted with a member 6 to prevent the second end of the rope from entering the cavity of the hollow pole. The shape of the member 6 may be a sphere or a round plate, and the diameter of the member must be larger than the diameter of the cavity of the pole.

Figure 6:
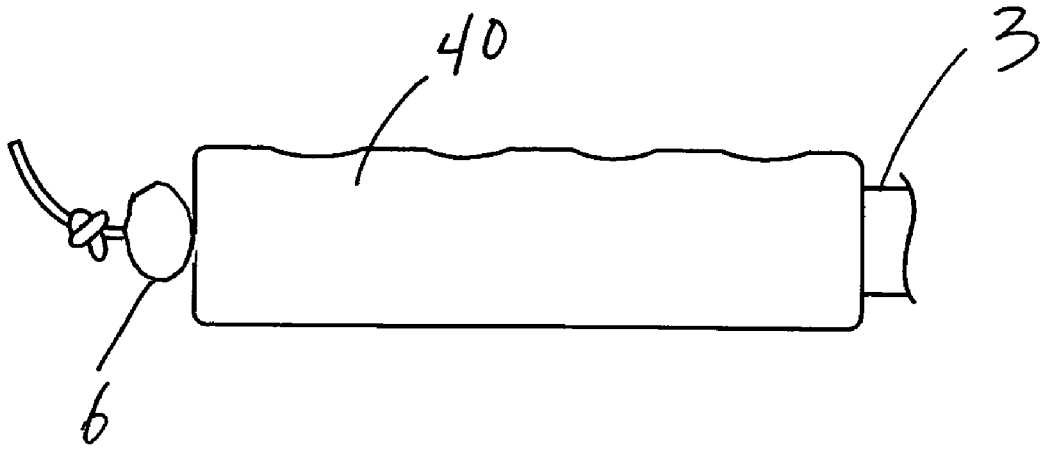
FIG. 6 is a plain view of a grip cover which covers the second end of a hollow pole of the tennis training device.
Figure 7:
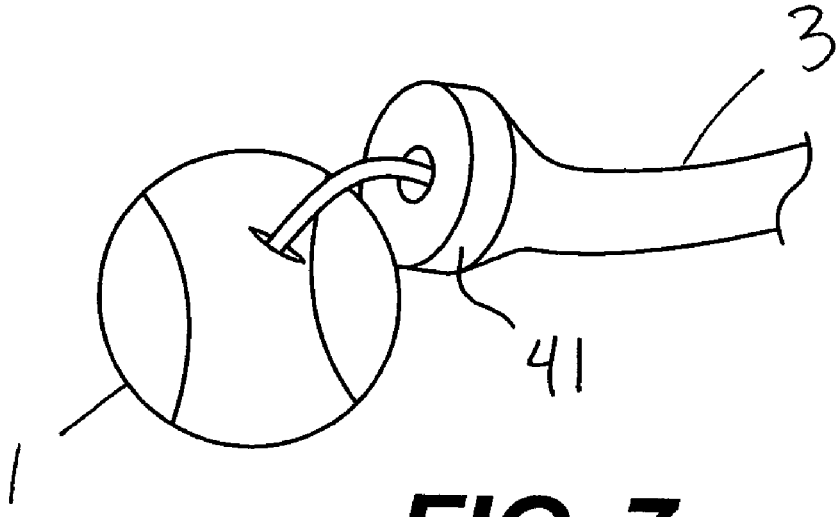
FIG. 7 is a plain view of a cap which covers the first end of the hollow pole of the tennis training device.

As shown in FIG. 6, a portion of the hollow pole near its second end may be covered by a grip cover 40. The grip cover is made of an ergonomically comfortable material such as rubber and silicon rubber. The shape of the grip cover 40 is preferably ergonomic. As shown in FIG. 7, the second end of the hollow pole 3 is preferably covered by a cap 41. The cap 41 is effective to prevent the ball 1 from being damaged to absorb the shock when the rope is pulled into the cavity of the hollow pole and ball is touched with the first end of the hollow pole. Material of the cap 41 is preferably rubber or silicon rubber.

Figure 8:
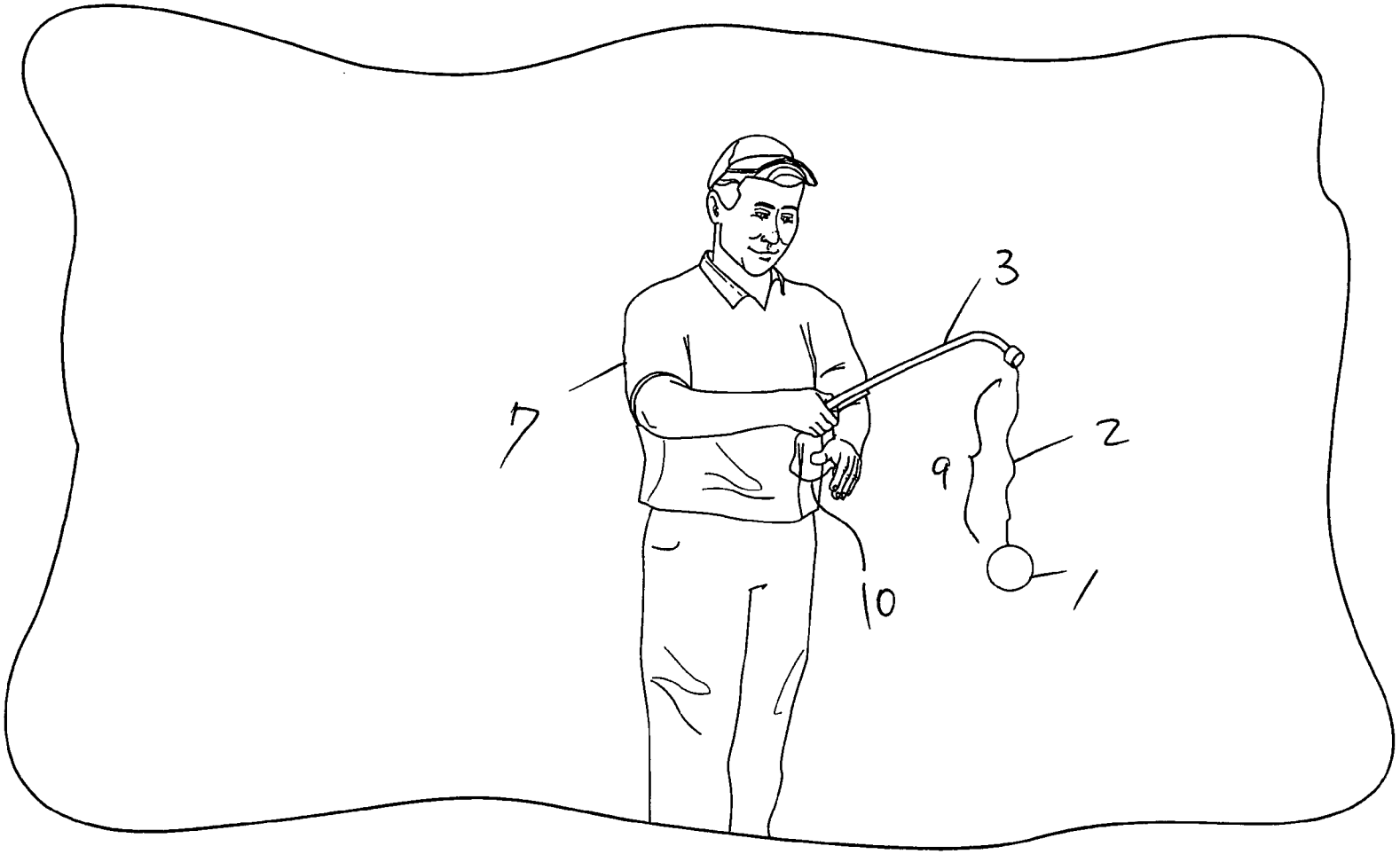
FIG. 8 is a perspective view of one embodiment of a method of training tennis skills with the tennis training device shown in FIG. 1.
Figure 9:
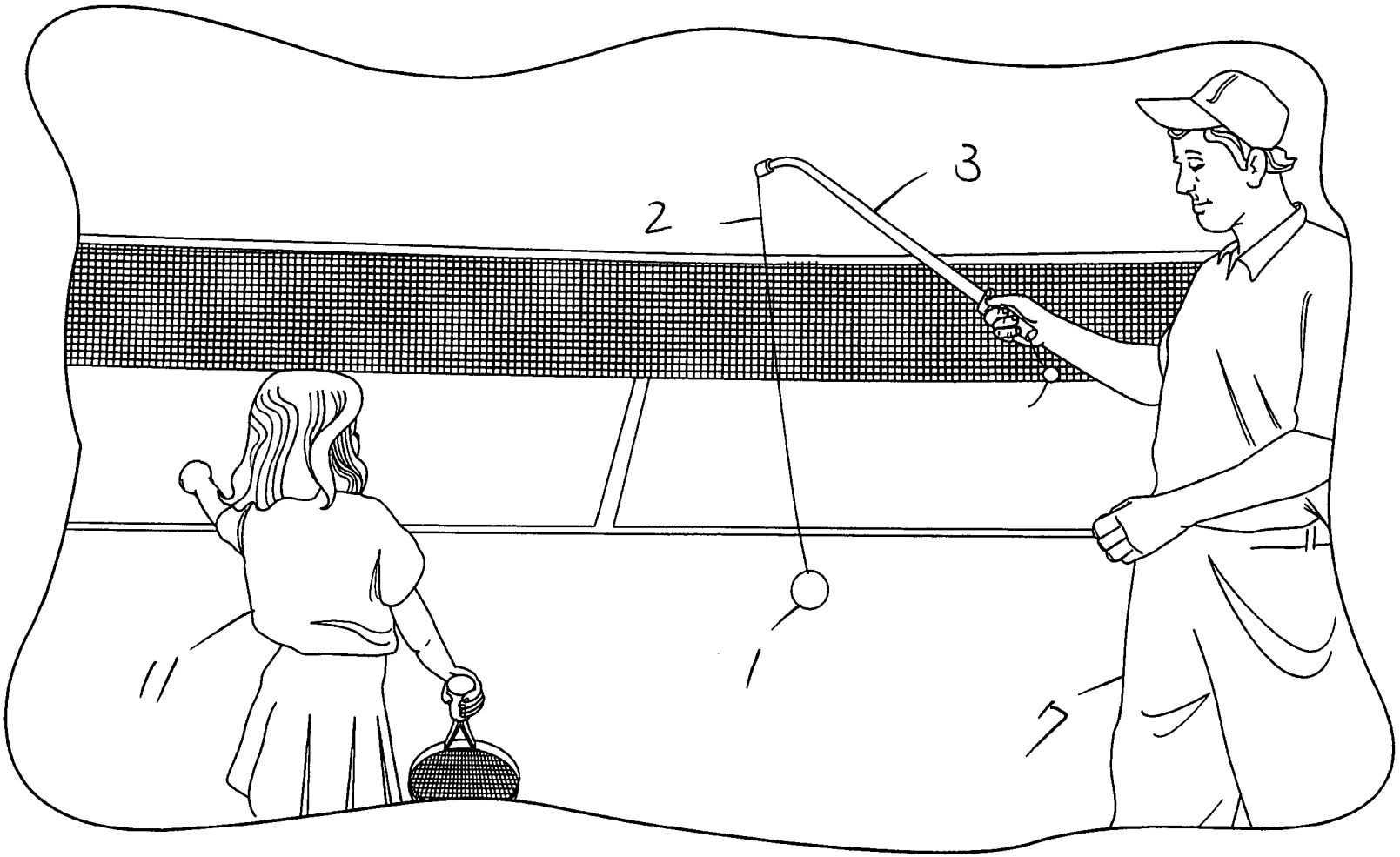
FIG. 9 is a perspective view of a method of training a serve with the tennis training device shown in FIG. 1.
Figure 10:
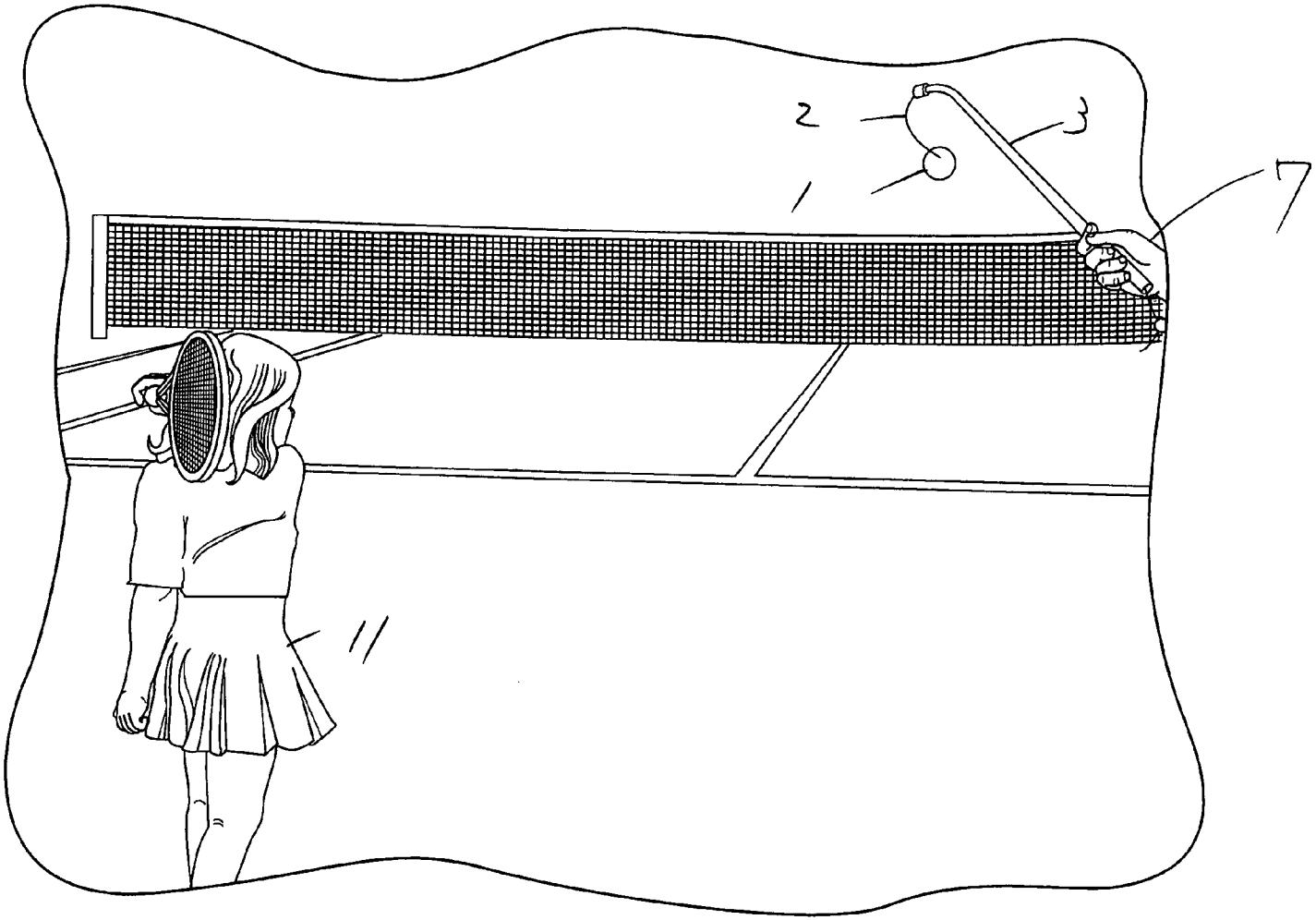
FIG. 10 is a perspective view of a method of training a stroke with the tennis training device shown in FIG. 1.

FIG. 8 show perspective views of a method of training tennis skills of the present invention. As shown in FIG. 8, a trainer 7 grabs a grip part of the tennis training device of the present invention. The first portion of the rope 2 is outside the hollow pole 3 between first end of the hollow pole 3 and the first end of rope 2. The trainer adjusts the length 9 of first portion of the rope 2 by pulling the second end 10 of the rope 2. The trainer extends the pole 3 away from the trainer's body and holds to set the position of the ball 1 at a height according to the height of a player and the kind of tennis shot, i.e. serve, stroke, smash and volley. FIG. 9 shows a perspective view of training a serve. FIG. 10 shows a perspective view of training a ground stroke. The trainer 7 releases the second portion of the rope 2 once the ball 1 is set at the selected height. Then, the player 11 is allowed to hit the ball 1 with a tennis racquet. The trainer may repeat this procedure: adjusting the length of the first portion of the rope 2, setting the position of the ball 1 at a selected height, releasing the second portion of the rope 2, and allowing the player to hit the ball with a racquet. This method helps a player to visualize proper ball placement because the ball to be hit stays at a static position when he/she hits the ball. Moreover, this method helps a player to build confidence in tennis skills because the player can experience an impact in doing proper shots.

Figure 11:
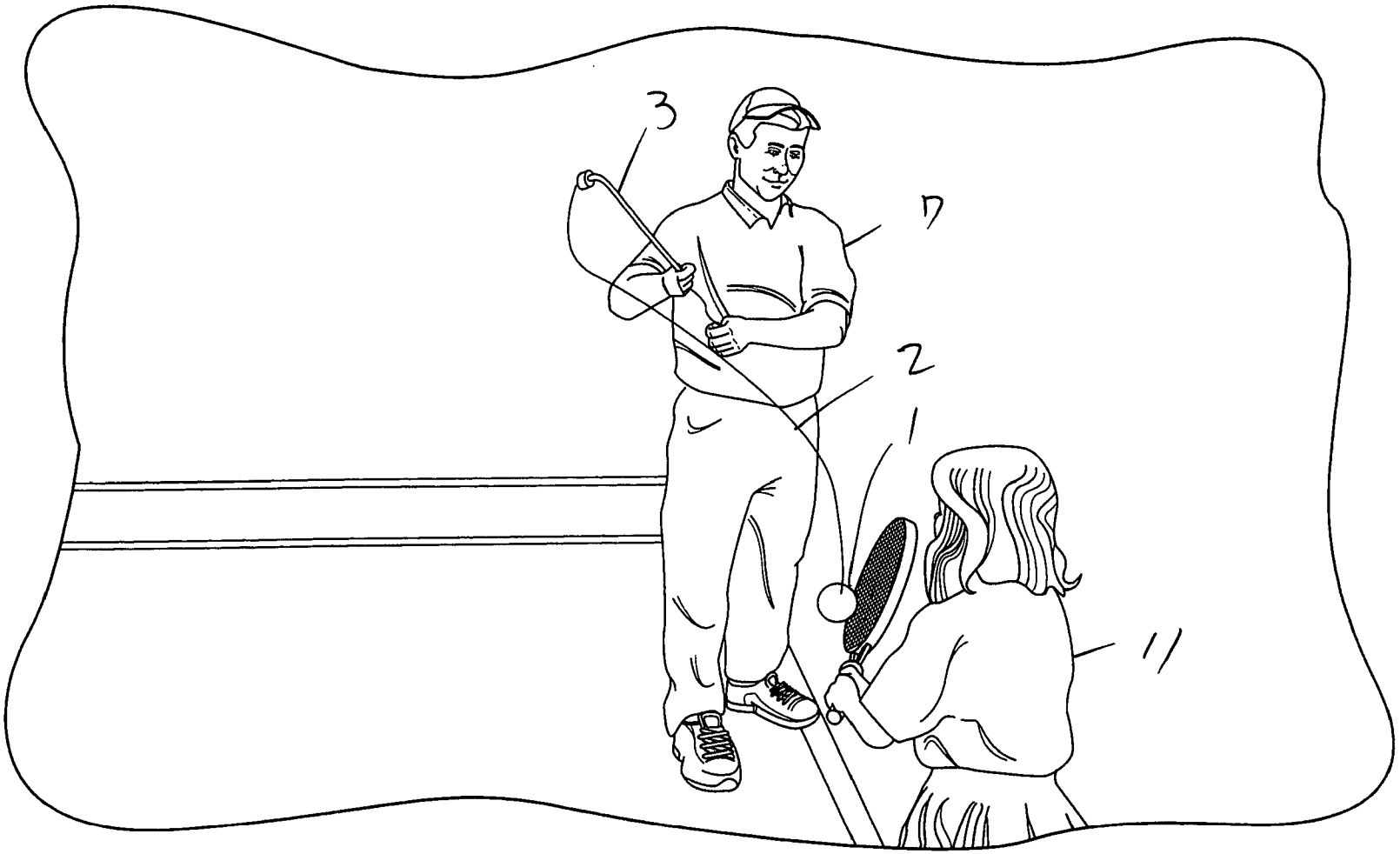
FIG. 11 is a perspective view of a method of training a stroke for a moving target with the tennis training device shown in FIG. 1.

The trainer may stand at a location distant from the player to allow the player to step in and then hit the ball with a racquet. The trainer may change the location at which he/she stands and allow a player to step in various positions and then stroke the ball. Moreover, while the trainer sets the ball at a desired position, he/she may allow the player to stay at the center point of the base at first, run toward the ball, stroke the ball with the racquet, return to the center point of the base line and repeat these procedures. Preferably, the location of the trainer is near a single line of the tennis court. As shown in FIG. 11, the trainer 7 may swing the rope 2 in a direction parallel to the player 11 to practice a stroke with the ball in various positions to learn the timing of a stroke.

Figure 12:
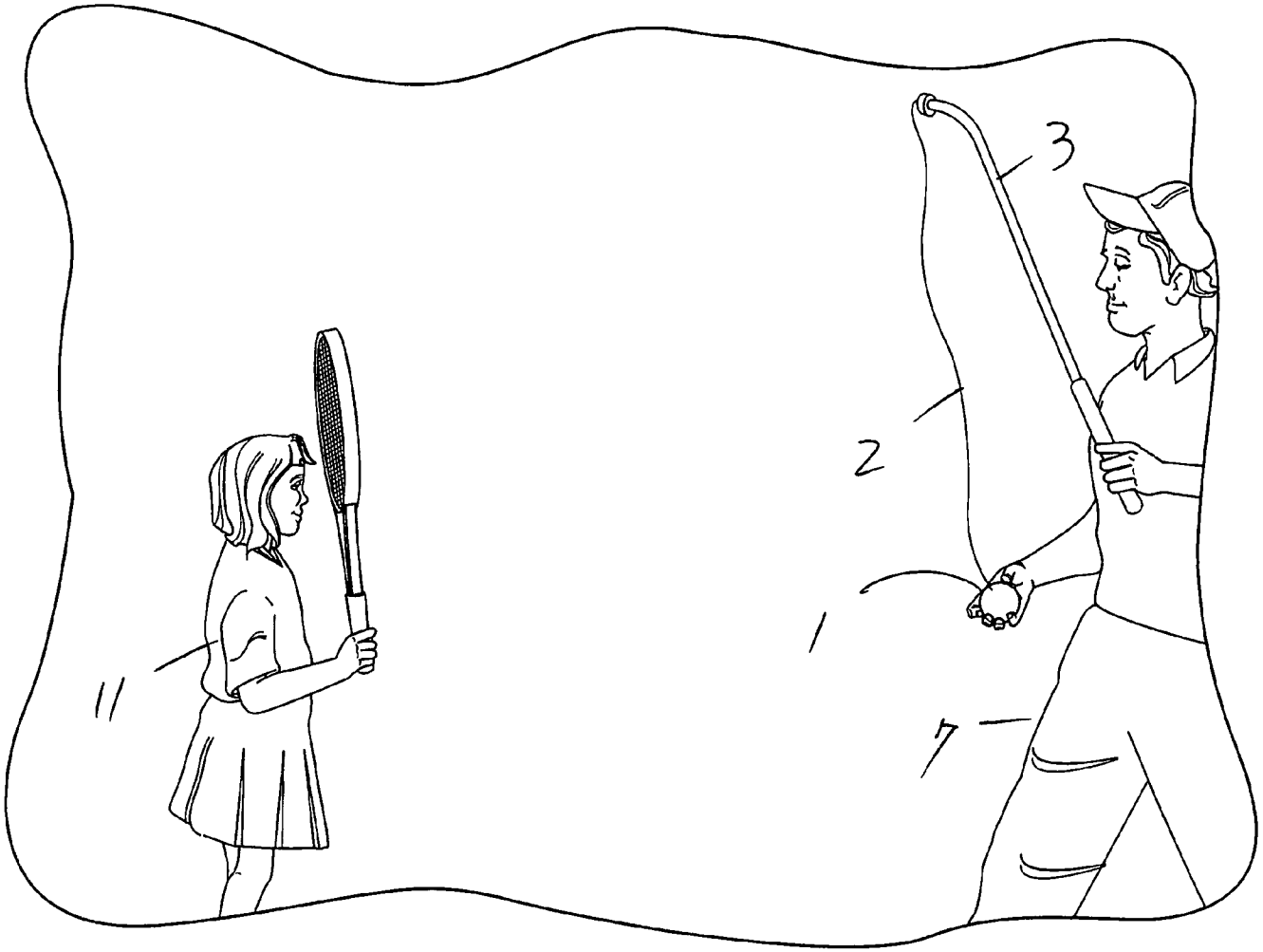
FIG. 12 is a perspective view of a method of training a volley with the tennis training device shown in FIG. 1.

The trainer may swing the rope 2 toward the player, or the face of the racquet held by the player to practice a volley. Alternatively, as shown in FIG. 12, the trainer 7 may grab the ball 1 and throw the ball toward the face of the racquet. The trainer may move in a direction parallel to the player 11 and repeat the procedure comprising the steps of grabbing the ball, throwing the ball toward the face of racquet, and allowing the player to volley the ball while the player moves in the same direction as that of the trainer's movement. The trainer may grab the ball, throw the ball toward a point at a distance enough for a player to step in and reach the ball with a racquet, and allow the player to step in and volley the ball. The trainer may change the height of the thrown ball and allow the player to volley the ball.

The trainer may hold the pole to set the ball at a certain height to allow the player to serve the ball and allow a player to slide the face of racquet touching the surface of the ball to let him/her learn how to spin the ball.

Figure 13:
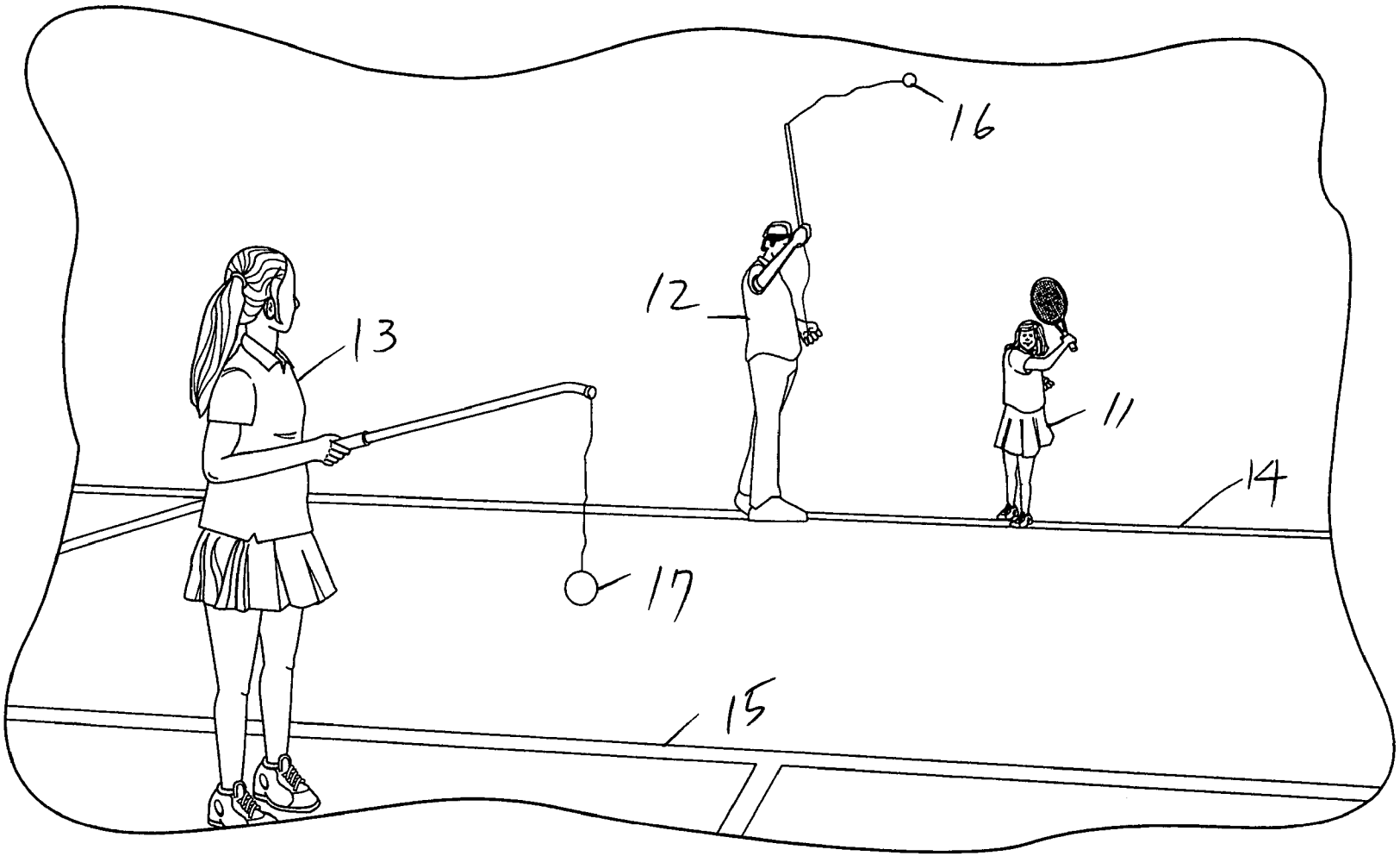
FIG. 13 is a perspective view of another embodiment of a method of training a combination of a serve and volley with the tennis training device shown in FIG. 1.

FIG. 13 shows a method of training a combination of a serve and a stroke. A first trainer 11 stands near the base line 14 of the court and a second trainer 13 stands closer to the net than the first trainer, preferably near a service line 15. The first trainer grabs the grip part of the tennis training device shown in FIG. 1. The first portion of the first rope is outside the hollow pole between the first end of the hollow pole and the first end of the first rope. The trainer adjusts the length of the first portion of the first rope by pulling the second end of the rope. The trainer holds the first pole to set the position of the first ball 16 at a height appropriate for a player to serve the ball. The trainer releases the second portion of the first rope once the first ball is set at the selected height. As well, the second trainer 13 grabs grip part of a second tennis training device shown in FIG. 1. A first portion of a second rope is outside a second hollow pole between the first end of the second hollow pole and the first end of the rope. The trainer adjusts the length of the first portion of the second rope by pulling the second end of the second rope. The trainer holds the second hollow pole to set the position of the second ball 17 at a height appropriate for a player to volley the ball. A player is allowed to serve the first ball 16 set by the first trainer first, run toward the second ball 17 set by the second trainer, and volley the second ball.

Figure 14:
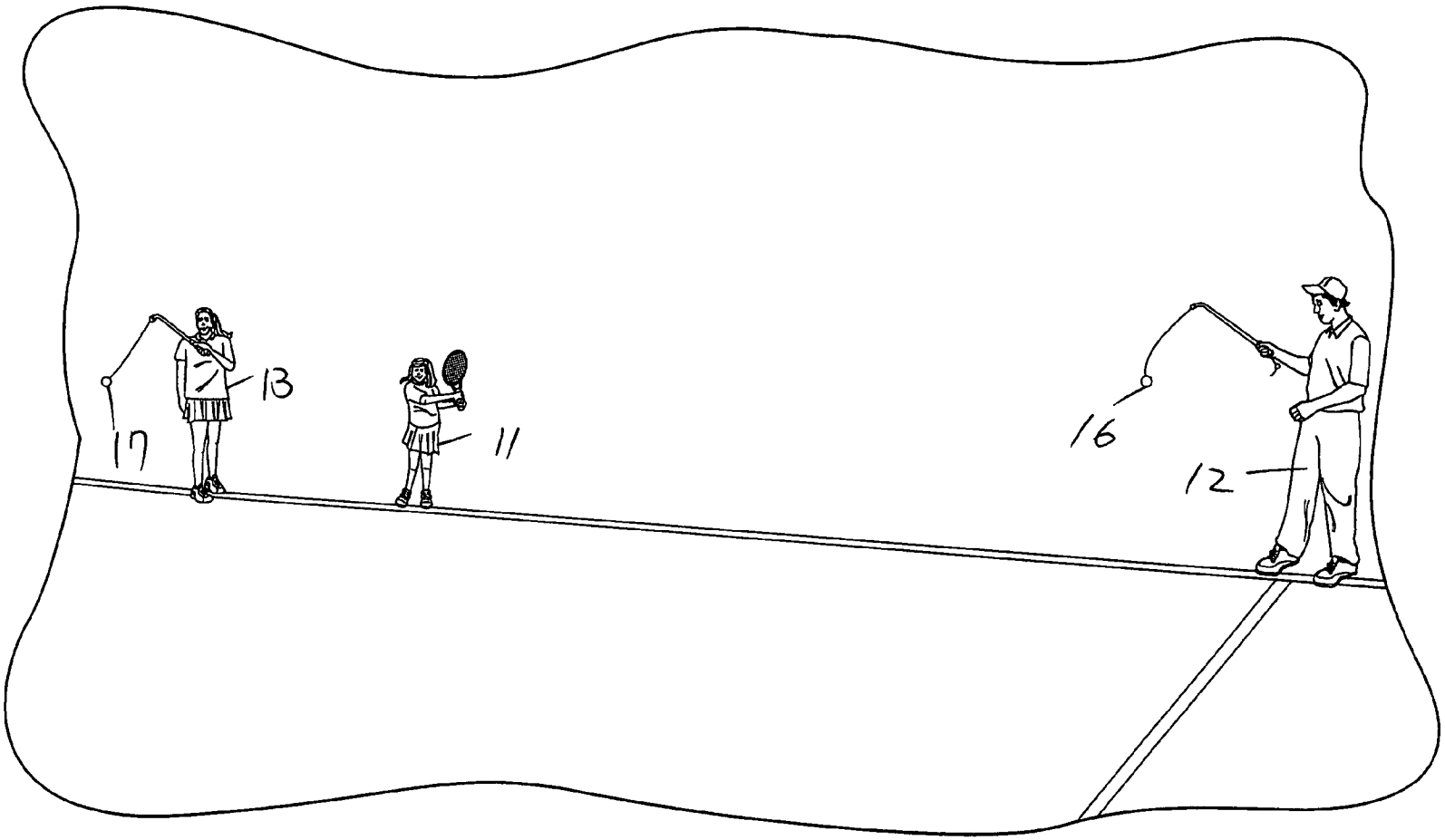
FIG. 14 is a perspective view of another embodiment of a method of training ground strokes with the tennis training device shown in FIG. 1.

FIG. 14 shows a method of training ground strokes. A first trainer 12 and a second trainer 13 stand along the base line at different locations. Preferably, the first trainer 12 and the second trainer 13 stand near right single line and left single line or vice versa, respectively. The first trainer and the second trainer grab a grip part of each of the tennis training device shown in FIG. 1. The first portion of the first rope is outside the first hollow pole between the first end of the first hollow pole and the first end of first rope. The trainer adjusts the length of the first portion of the first rope by pulling the second end of the first rope. As shown in FIG. 14, the first trainer and the second trainer hold the pole to set the positions of the first ball 16 and the second ball 17 at a height appropriate for a player to stroke. The first ball 16 and the second ball 17 may be set at different heights. A player is allowed to stand at approximately the middle of the base line, run toward the first ball 16 set by the first trainer 12 and stroke the first ball, run toward the second ball 17 set by the second trainer 13 and stroke the second ball. The trainers may repeat the procedure comprising the steps of adjusting the length of the first portion of the ropes; releasing the second ends of the ropes, holding the poles to set the balls appropriate for a tennis player to stroke the balls, allowing a player to run toward a first ball set by first trainer, stroke the first ball, then run toward a second ball set by second trainer and stroke the second ball.

Figure 15:
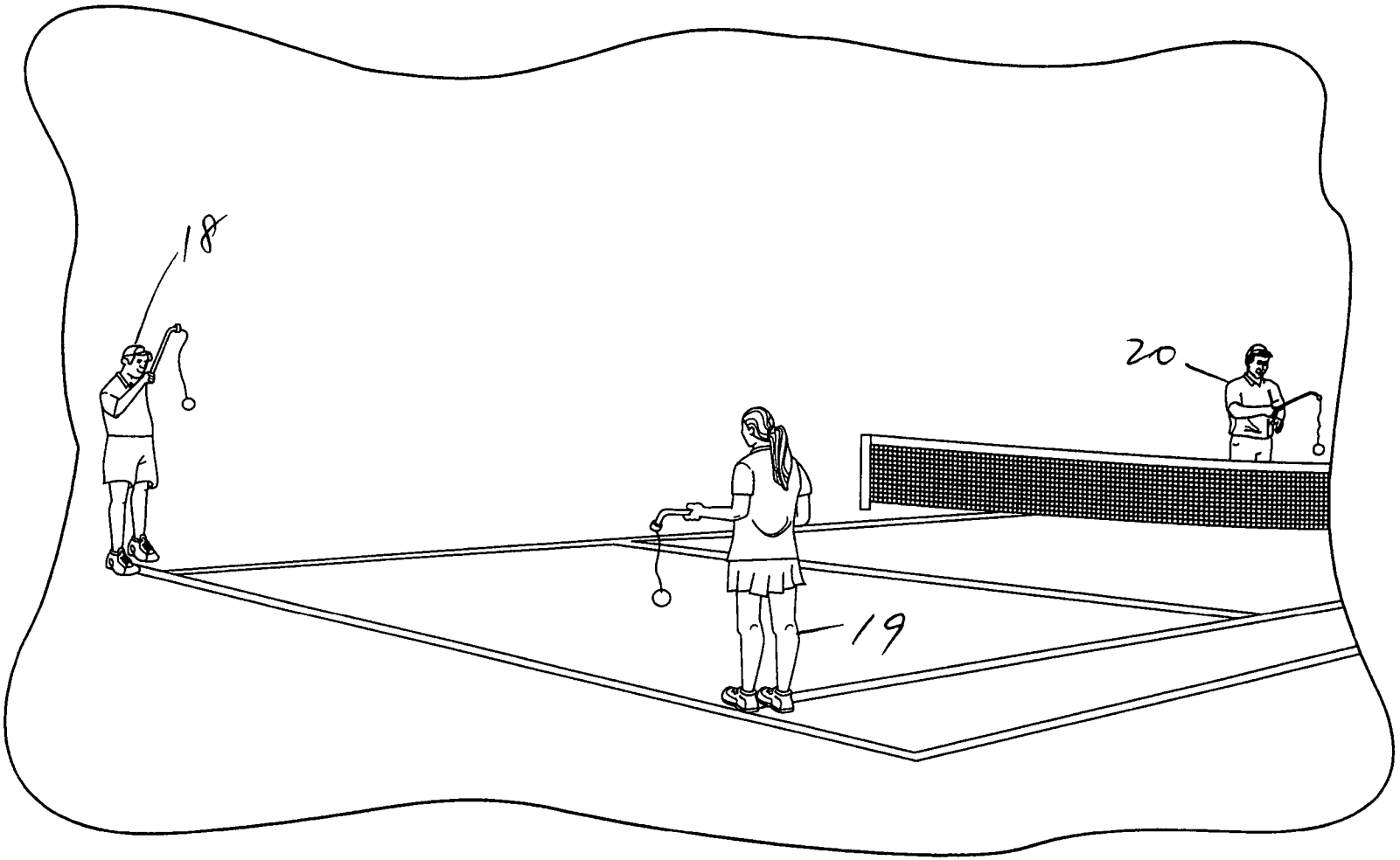
FIG. 15 is a perspective view of another embodiment of a method of training a combination of ground strokes and a volley with the tennis training device shown in FIG. 1.

FIG. 15 shows a method of training a combination of ground strokes and a volley. A first trainer 18 and a second trainer 19 stand along the base line at different locations. Preferably, the first trainer and the second trainer stand near right single line and left single line or vice versa, respectively. The third trainer 20 stands near a net of a tennis court in a side opposite to that in which the first trainer 18 and the second trainer 19 stand. The first trainer grabs a grip part of a first tennis training device as shown in FIG. 1. The first portion of the first rope is outside the first hollow pole between the first end of the first hollow pole and the first end of first rope. The first trainer adjusts the length of the first portion of the first rope by pulling the second end of the first rope. As well, the second trainer grabs grip part of a second tennis training device as shown in FIG. 1. The first portion of the second rope is outside the second hollow pole between first end of the second hollow pole and the first end of second rope. The second trainer adjusts a length of the first portion of the second rope by pulling the second end of the second rope. As shown in FIG. 15, the first trainer and second trainer hold each pole to set the position of the first ball and the second ball at a height appropriate for a player to stroke these balls. A player is allowed to stand at approximately the middle of the base line, run toward the first ball set by the first trainer 18, stroke the first ball, then run toward the second ball set by the second trainer 19, stroke the second ball. Then, the player is allowed to run toward the third trainer 20. When the player reaches near the net, the third trainer 20 throws the third ball toward the player or the face of the racquet held by the player and allows the player to volley the third ball.

Figure 16:
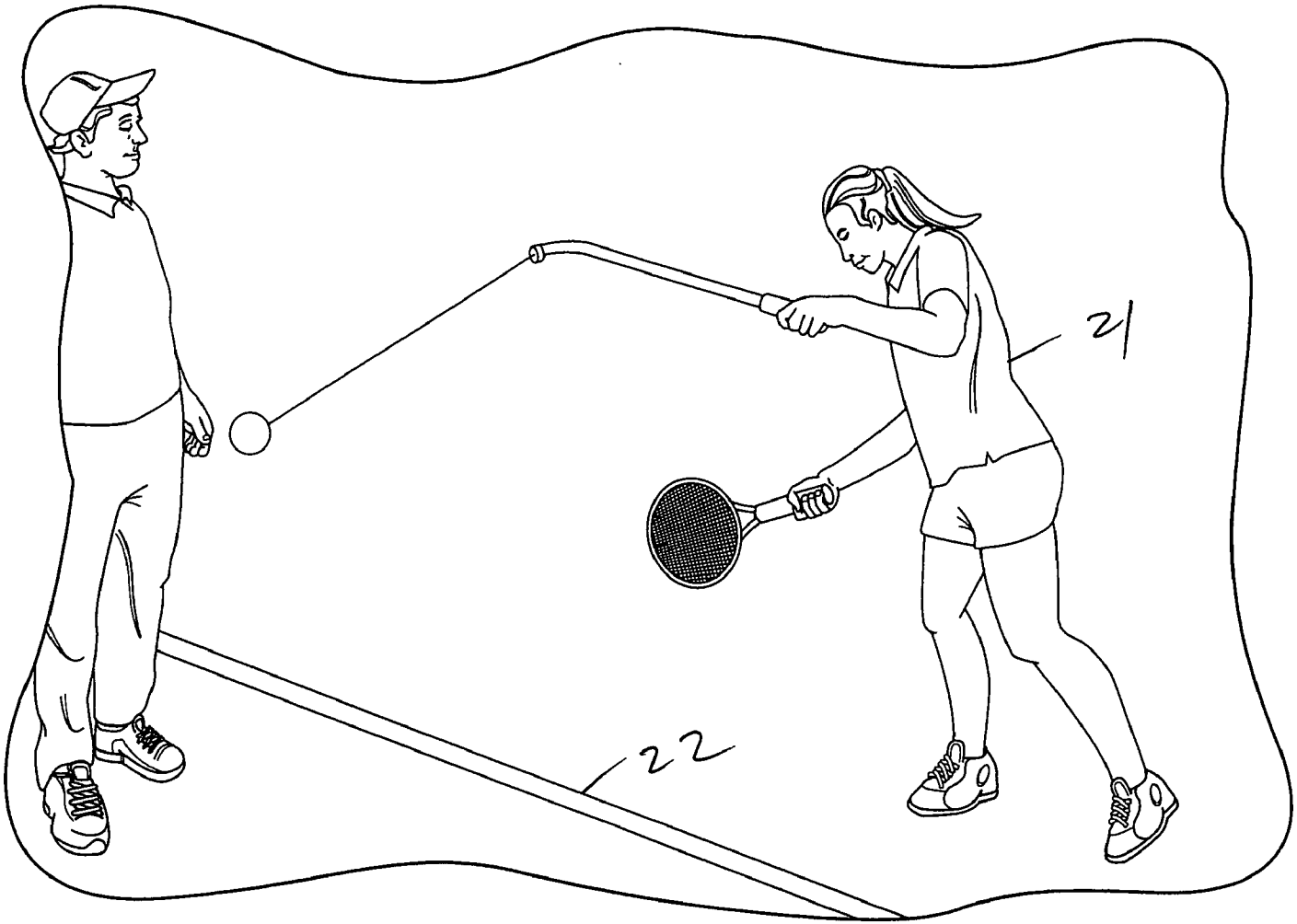
FIG. 16 is a perspective view of another embodiment of a method of self-training with the tennis training device shown in FIG. 1.
Figure 16A:
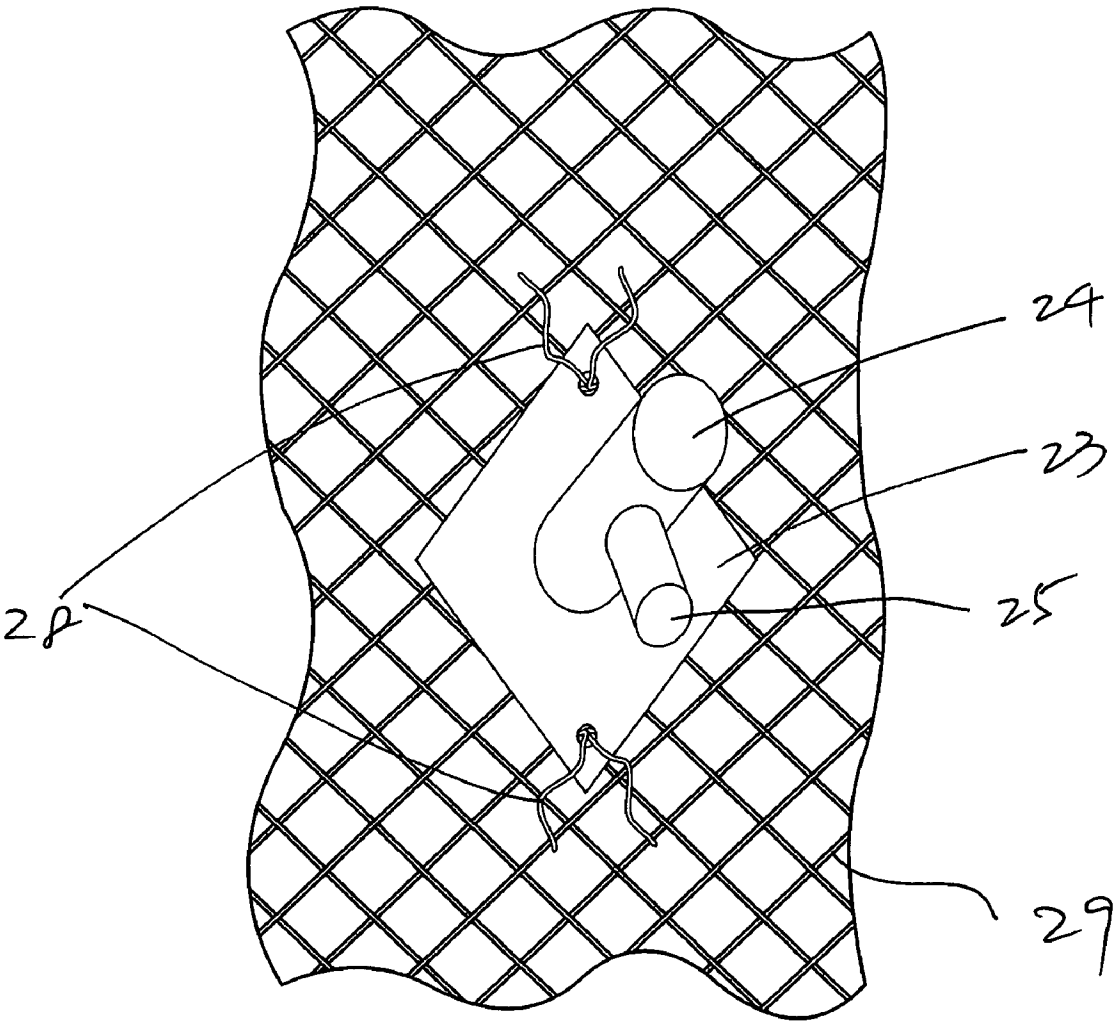
Figure 16C:
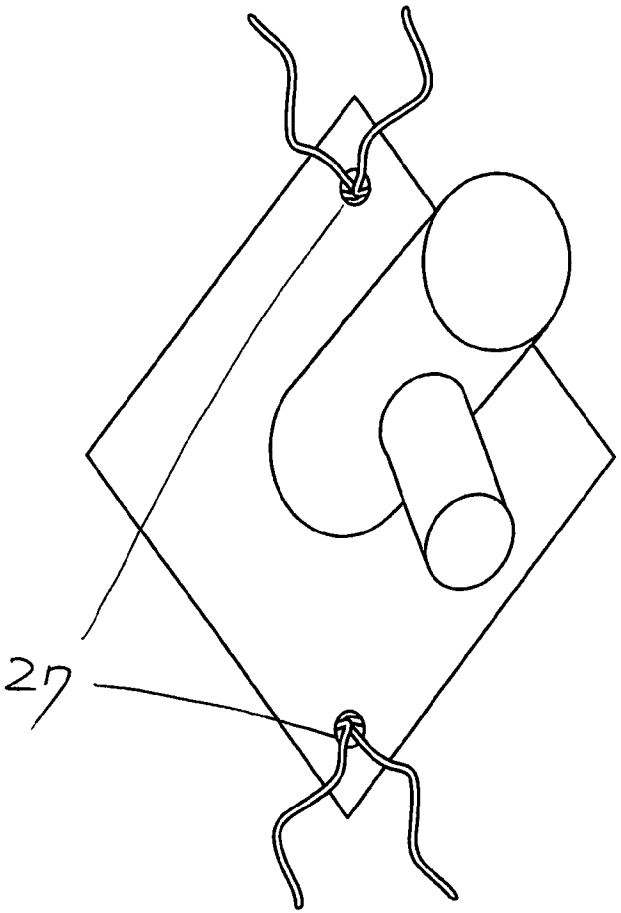
Figure 16B:
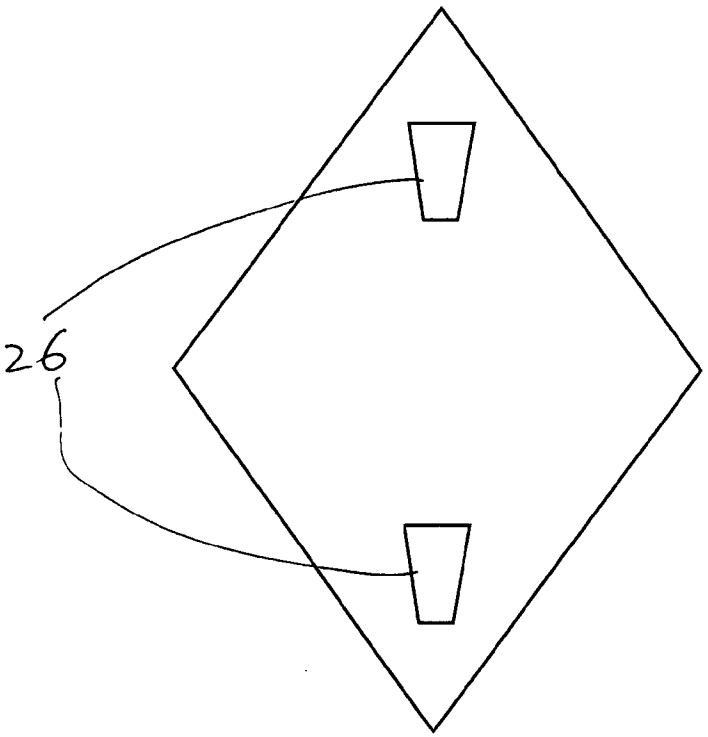

FIG. 16 shows a method of self-training. A player 21 is allowed to grab the grip part of the tennis training device as shown in FIG. 1, adjust the length of the first portion of the rope and holds the second end of the rope to prevent the second end of the rope and keep the same length of first portion of the rope when he/she hits the ball with a racquet. Then, the player is allowed to hit the ball with a tennis racquet. The player may move along the line 22 and hit the ball with a racquet.

FIGS. 16 (*a-c*) show an apparatus for supporting the tennis training device as shown in FIG. 1. The apparatus comprises a base 23, a column 24, and a tube 25. The base 23 preferably comprises one or more hooks 26 on the back of the base to connect with a fence 29. Alternatively, the base comprises one or more holes 27. Preferably, an elastic rope 28 is coupled with one or more hooks or one or more holes on the back of the base to secure the base more tightly with the fence. The column 24 is attached on the base 23. The tube 25 comprises a first end being coupled with a side of the column 24 and a second end adapted for coupling with the second end of the hollow pole 3 of the tennis training device. The column can rotate up to 180 degrees so that the direction of the tube is changed according to a player's selection. For example, according to a player's dominant hand, forward stroke or backhand stroke, and the height of the ball, the direction of the tube can be changed. Alternatively, while the column is secured on the base, a part of the base including the part coupling with the column may be rotated up to 180 degrees. The location of placing the base is not limited to a fence. The base may be placed on the floor.

Figure 17:
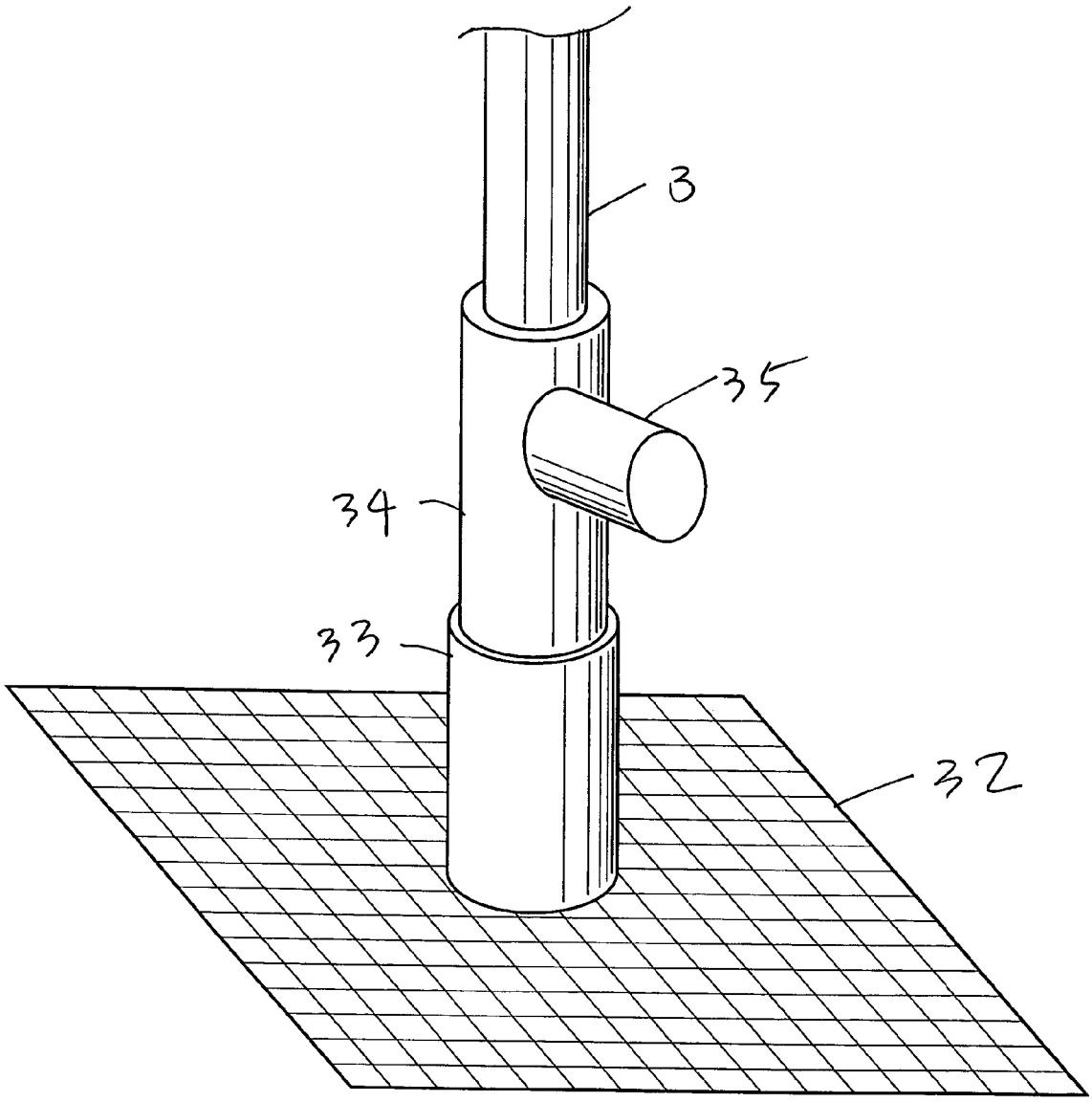
FIG. 17 is a plain view of another embodiment of a member for supporting the tennis training device shown in FIG. 1.

FIG. 17 shows an alternative apparatus for supporting the tennis training device shown in FIG. 1. The apparatus comprises a base 32, a first column 33, a second column 34 and a tube 35. The base 32 is adapted for being placed on the floor, ground or court surface. First column 33 is attached on the base. The second column 34 is adapted for connecting with the top of the first column 33 to adjust the height of the ball of the tennis training device. The diameter of the second column 33 is preferably smaller than the diameter of the first column, and one end of the second column is movably engaged within the first column. The opposite end of the second column is adapted for coupling with the hollow pole 3 of the tennis training device. Additionally, the first end of the tube 35 may be coupled with a side of the column 34 and the second end of the tube 35 is adapted for coupling with the hollow pole 3 of the tennis training device. The second column can rotate up to 360 degrees. Alternatively, while the first column is secured on the base, a part of the base including the part attaching the first column may be rotated up to 360 degrees.

What is claimed is:

1. A tennis training device comprising:

a ball;

a rope, a portion of a first end of the rope being coupled with the ball and a portion of a second end of the rope being knotted;

a hollow role comprising a first end and a second end, a part of the rope being in a cavity of the hollow pole, the other part of the rope being outside the hollow pole; and a member for supporting the hollow pole, the member for supporting the hollow pole comprising a base;

a column being attached on the base; and a tube comprising a first end being coupled with a side of the column and a second end adapted for coupling with the hollow pole.

2. The device according to claim 1, wherein the base comprises a hook on a back of the base.

3. The device according to claim 2, comprising an elastic rope to couple the base with a fence, the elastic rope being coupled with the hook.

4. The device according to claim 1, wherein the base comprises a hole and an elastic rope being thread through the hole and coupling the base with the fence.

5. The device according to claim 1, wherein a part of the base rotates up to 180 degrees.

6. The device according to claim 1, wherein the column rotates up to 180 degrees.

7. The device according to claim 1 comprising a washer, wherein the ball comprises a cut, the rope is knotted with the washer, and the washer is inserted through the cut into the ball.

8. The device according to claim 7 wherein the washer is 5/16washer.

9. The device according to claim 8 wherein a length of the cut on the surface of the ball is approximately the same as a diameter of the washer.

10. The device according to claim 9 wherein a depth of the cut is approximately 2.5 inches.

11. The device according to claim 1 wherein a part near the first end of the hollow pole is bent.

12. The device according to claim 1 wherein the first end of the hollow pole is attached with a rubber cap comprising a hole to pass through the rope.

13. The device according to claim 1 wherein the length of the rope is approximately 7 feet.

14. The device according to claim 1 wherein the hollow pole is 33 inches long.

15. The device according to claim 1 wherein the rope is made of nylon.

16. The device according to claim 1 wherein a portion of the pole near the second end of the pole is covered by a grip cover.

17. The device according to claim 1 wherein the second end of the rope is coupled with a member for preventing the second end of the rope from entering a cavity of the hollow pole.

18. The device according to claim 17 wherein the member comprises a ball with a diameter larger than a diameter of the cavity of the hollow pole.

19. A tennis training device comprising:

a ball;

a rope, a portion of a first end of the rope being coupled with the ball and a portion of a second end of the rope being knotted;

a hollow pole comprising a first end and a second end, a part of the rope being in a cavity of the hollow pole, the other part of the rope being outside the hollow pole; and a member for supporting the hollow pole, the member for supporting the hollow pole comprising a base;

a first column being attached on the base;

a second column being coupled with a top of the first column; and a tube comprising a first end being coupled with a side of the column and a second end being adopted for being coupled with the hollow pole.

20. The device according to claim 19, wherein a diameter of the second column being smaller than a diameter of the first column.

21. The device according to claim 19, wherein a part of the base rotates up to 180 degrees.

22. The device according to claim 19, wherein the second column rotates up to 180 degrees.

23. The device according to claim 19, comprising a stopper for preventing the ball from entering a cavity of the tube, the stopper being attached with a portion of the second end of the tube.

24. A tennis training device comprising:

a tennis ball;

a pole comprising a first end, a second end opposite the first end, and a hollow cavity extending between the first end and the second end, wherein a portion of the pole near the second end of the pole includes a grip cover;

a rope having a first end portion extending from the first end of the pole and being coupled with the tennis ball, a middle portion extending through the hollow cavity of the pole, and a second portion extending from the second end of the pole, wherein the second end of the rope is coupled with a member for preventing the second end of the rope from entering the hollow cavity of the pole; and wherein a portion of the pole near the first end of the pole is bent at a bending angle to allow the tennis ball not to touch the pole when the pole is positioned vertically.

25. The device according to claim 24, further comprising a washer, wherein the ball comprises a cut the rope is knotted with the washer, and the washer is inserted through the cut into the ball.

26. The device according to claim 25, wherein the washer is 5/16washer.

27. The device according to claim 26, wherein a length of the cut on the surface of the ball is approximately the same as a diameter of the washer.

28. The device according to claim 27, wherein a depth of the cut is approximately 2.5 inches.

29. The device according to claim 24, wherein the first end of the hollow pole is attached with a rubber cap comprising a hole to pass through the rope.

30. The device according to claim 24, wherein the length of the rope is approximately 7 feet.

31. The device according to claim 24, wherein the hollow pole is 33 inches long.

32. The device according to claim 24, wherein the rope is made of nylon.

33. The device according to claim 24, wherein the member comprises a ball with a diameter larger than a diameter of the cavity of the hollow pole.

* * * * *